US007074084B2

(12) United States Patent
Shuey et al.

(10) Patent No.: US 7,074,084 B2
(45) Date of Patent: Jul. 11, 2006

(54) SHIELDED BLIND-MATE CONNECTOR

(75) Inventors: Scott A. Shuey, Harrisburg, PA (US); Mike Walmsley, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/961,725

(22) Filed: Oct. 8, 2004

(65) Prior Publication Data

US 2006/0079112 A1 Apr. 13, 2006

(51) Int. Cl.
*H01R 13/648* (2006.01)

(52) U.S. Cl. ..... 439/607; 439/247

(58) Field of Classification Search ..... 439/607, 439/609, 378, 545, 247, 248, 95, 108, 939
See application file for complete search history.

(56) References Cited

U.S. PATENT DOCUMENTS 5,161,996 A 11/1992 Locati ..... 439/374
5,286,222 A * 2/1994 Yagi et al. ..... 439/607
5,391,091 A 2/1995 Nations ..... 439/378
5,466,171 A 11/1995 Bixler et al. ..... 439/378
5,984,726 A * 11/1999 Wu ..... 439/607
6,033,263 A * 3/2000 Weidler et al. ..... 439/620
6,059,581 A * 5/2000 Wu ..... 439/79
6,113,426 A * 9/2000 Lin ..... 439/607
6,139,367 A * 10/2000 Yeh ..... 439/609
6,165,015 A * 12/2000 Wu et al. ..... 439/607
6,234,817 B1 * 5/2001 Hwang ..... 439/247
6,319,063 B1 * 11/2001 Huang ..... 439/610
6,364,707 B1 * 4/2002 Wang ..... 439/607
6,398,587 B1 * 6/2002 Chen et al. ..... 439/607
6,494,744 B1 * 12/2002 Lee ..... 439/610
6,533,612 B1 * 3/2003 Lee et al. ..... 439/607

* cited by examiner

*Primary Examiner*—Ross Gushi

(57) ABSTRACT

A connector for use in a blind-mate connector assembly includes a conductive shield that has a guidance element for a mating blind-mate connector having a floating receptacle. A housing is substantially enclosed within the shield. The housing includes a mating end and a mounting end and has a back wall at the mounting end. A protrusion extends from the back wall. The back wall has a lower surface that includes a connector mounting surface. The protrusion is configured to be received in the mating blind-mate connector. The guidance element of the shield positions the floating receptacle of the mating blind-mate connector about the protrusion.

15 Claims, 6 Drawing Sheets

SHIELDED BLIND-MATE CONNECTOR

BACKGROUND OF THE INVENTION

The invention relates generally to electrical connectors, and more particularly to a shielded electrical connector assembly for blind-mating.

Electrical connectors are commonly used to interconnect electrical circuits or components to one another. In some applications, a receptacle connector may be mounted in an area where access to the receptacle is restricted for mating a plug assembly to the receptacle connector. For instance, the receptacle connector may be located in a recessed area or in an interior of an electronic device. Such receptacle locations are common in electronic devices having peripheral devices and accessories, such as, for example, a PC having a removable disk drive which is interchangeable with other types of disk drives or plug-in devices. In such situations, the process of mating a plug to the receptacle is often such that the engagement of the plug to the receptacle is not visually observable. In such instances, the mating process is referred to as blind mating of the plug and the receptacle.

In a blind mate connector assembly, typically, one of the plug and receptacle has some freedom to float or move transversely to the direction of mating to align itself with the other of the plug and receptacle. Conventionally, the plug and receptacle connectors are provided with complimentary mechanical alignment features such as a guide post on one of the connectors that is received in a channel or cavity in the other connector when the plug and receptacle connectors are mated. The alignment features provide guidance during the mating process and ensures proper engagement of the blind mating connector assembly.

Along with the general trend toward faster, smaller and higher performance electrical systems, particularly with regard to computer systems, there is an ongoing need for compact connector assemblies to occupy smaller spaces while also providing adequate electromagnetic interference (EMI) shielding to preserve signal quality. However, providing shielding for EMI suppression and alignment features in a blind-mate connector tends to add to the bulk of the connector assembly and to the space occupied by the connector assembly in use. It would be desirable to provide a blind mate connector assembly having EMI shielding in a more compact configuration for use with increasingly smaller devices.

BRIEF DESCRIPTION OF THE INVENTION

In one aspect, a connector for use in a blind-mate connector assembly is provided. The connector includes a conductive shield that has a guidance element for a mating blind-mate connector having a floating receptacle. A housing is substantially enclosed within the shield. The housing includes a mating end and a mounting end and has a back wall at the mounting end. A protrusion extends from the back wall. The back wall has a lower surface that includes a connector mounting surface. The protrusion is configured to be received in the mating blind-mate connector. The guidance element of the shield positions the floating receptacle of the mating blind-mate connector about the protrusion.

Optionally, the conductive shield of the connector includes a forward end and the guidance element includes a curved lip at the forward end of the shield. The shield includes a grounding tab at the forward end that is configured to engage a grounding element proximate the forward end. The shield also includes a plurality of flexible fingers, and each finger contacts a shield of the mating connector when the connector is joined with the mating connector. The protrusion has an upper surface and a lower surface, and the housing includes a plurality of electrical contacts, the plurality of electrical contacts including a first row of contacts in registry with the upper surface and a second row of contacts in registry with the lower surface.

In another aspect, a blind matable connector assembly is provided that includes a first connector having a first conductive shield that includes a guidance element. A first housing is substantially enclosed within the first conductive shield. The first housing includes a mating end and a mounting end, and a back wall at the mounting end. A protrusion extends from the back wall toward the mating end. The back wall has a lower surface that includes a connector mounting surface. A second connector is matable with the first connector and includes a second housing having a mating end and a mounting end. The mounting end includes a portion extending vertically upward substantially perpendicular to the mating end. The mounting end defines a mounting hole for movable attachment of the mounting end to a panel. A second conductive shield surrounds the mating end of the second housing. The guidance element of the first conductive shield receives the second conductive shield and the mating end of the second housing whereby the second connector self aligns for mating with the first connector.

In another aspect, a blind matable electronic assembly is provided. The electronic assembly includes a primary device that includes a first connector located in an interior region of the primary device. The first connector includes a first conductive shield. The first conductive shield includes a guidance element for a mating blind-mate connector and a first housing substantially enclosed within the first conductive shield. The first housing includes a mating end and a mounting end. The first housing has a back wall at the mounting end and a protrusion extending from the back wall toward the mating end. The back wall has a lower surface that includes a connector mounting surface. A peripheral device is located outside the primary device and is blind-matable with the primary device. The peripheral device includes a panel and a second connector matable with the first connector. The second connector includes a second housing having a mating end and a mounting end, the mounting end including a portion extending vertically upward substantially perpendicular to the mating end. The mounting end is movably mounted to the panel to permit relative movement of the mating end with respect to the panel. A second conductive shield surrounds the mating end of the second housing. The guidance element receives the second conductive shield and the mating end of the second housing whereby the second connector self aligns for blind-mating with the first connector to blind-mate the peripheral device with the primary device.

In another aspect, a panel mount connector for use in a blind-mate connector assembly is provided. The panel mount connector includes a housing having a mating end and a mounting end. The mounting end includes a portion that extends vertically upward substantially perpendicular to the mating end. The mounting end defines a mounting hole for movable attachment the mounting end to a panel. A conductive shield encases the mating end. The shield includes a grounding tab configured to engage a grounding element proximate the mounting end.

DETAILED DESCRIPTION OF THE INVENTION

Figure 1:
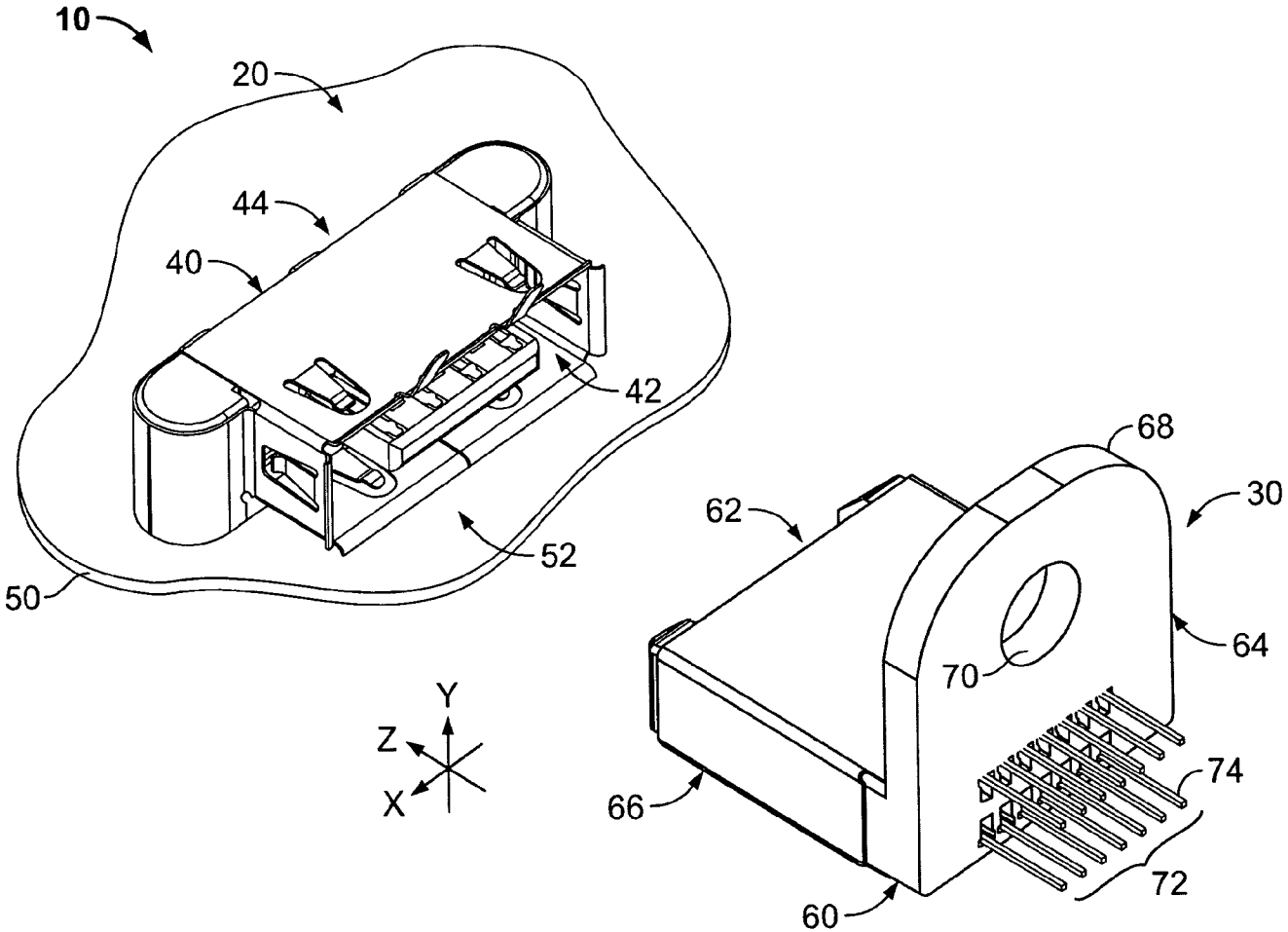
FIG. 1 is a perspective view of a blind-mate connector assembly according to an exemplary embodiment of the present invention.

FIG. 1 illustrates an blind-mate connector assembly 10 according to an exemplary embodiment of the present invention. The assembly 10 includes a first connector 20 and a second connector 30 that is matable to the first connector 20. In an exemplary embodiment, the first connector 20 is a plug connector mounted to a circuit board 50 within an electronic device (e.g., a PC) and the second connector 30 is a receptacle connector of a peripheral device (not shown) such as a disk drive. It is to be understood, however, that this is but one potential application of the inventive concepts herein.

The first connector 20 is substantially enclosed in a conductive shield 40 that is provided to minimize the effects of electromagnetic interference (EMI). The connector 20 has a mating end 42 and a mounting end 44 that is configured for mounting to a circuit board 50. The shield 40 includes a forward end 52 that provides guidance for the second connector 30 during the mating process. The shield 40 surrounds the mating end 42 of the first connector 20.

The second connector 30, in the illustrated embodiment, is a floating receptacle connector that is configured to be mounted to a panel (not shown in FIG. 1) of the peripheral device. The connectors 20 and 30 are mated by moving the connectors 20 and 30 together in the Z direction. During the mating process, the second connector 30 is free to move in the X and Y directions to align itself for blind-mating with the first connector 20. The second connector 30 includes a housing 60 that has a mating end 62 and a mounting end 64. The mating end 62 is surrounded by a conductive shield 66 that is provided to minimize EMI interference. The mounting end 64 includes a mounting tab 68 that extends vertically upward substantially perpendicular to the mating end 62. The tab 68 includes a mounting hole 70 to movably attach the mounting end 64 to the panel of the peripheral device. A plurality of electrical contacts 72 extend from the mating end 62 to the mounting end 64 of the housing 60. The contact ends 74 extend through the mounting end 64, and the contact ends 74 are connected to the peripheral device.

Figure 2:
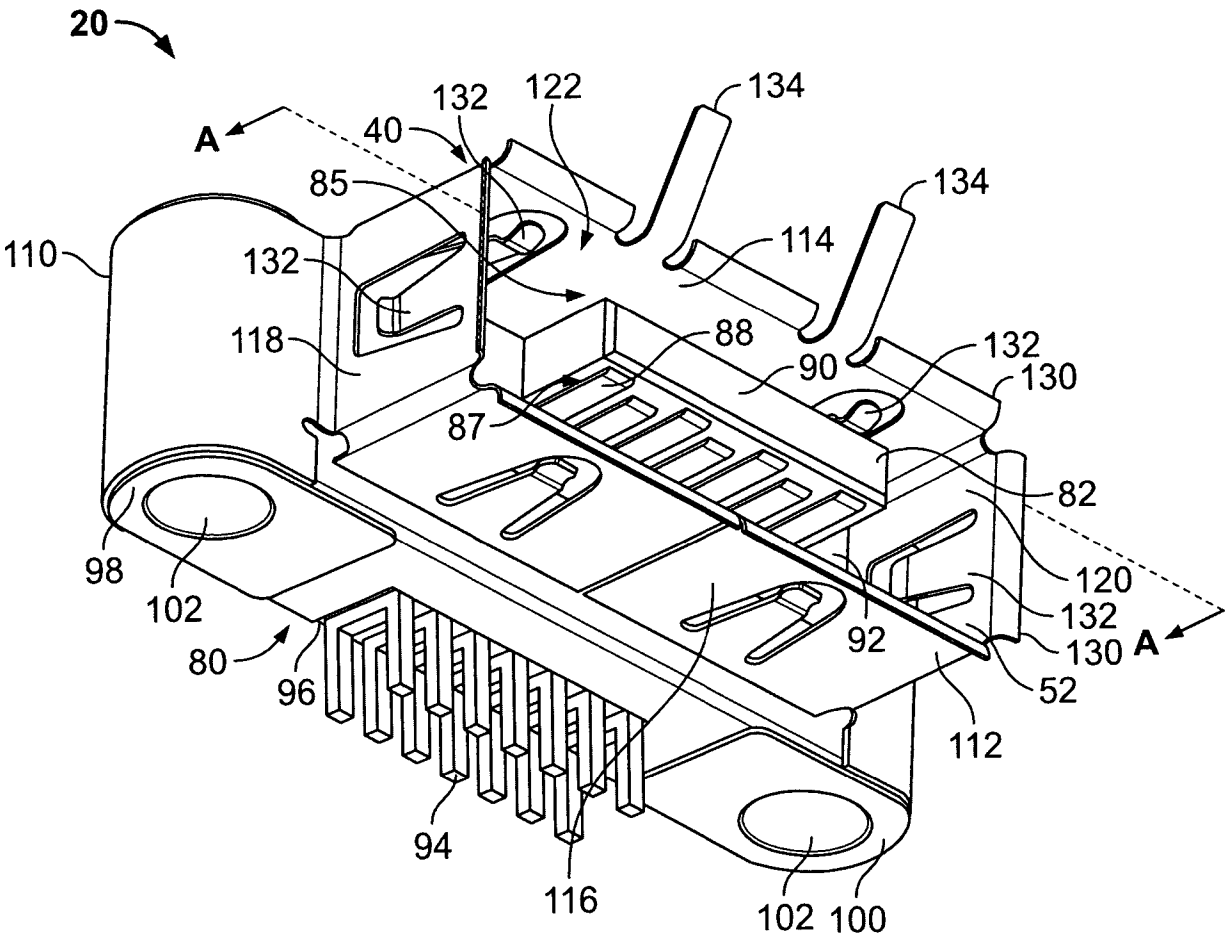
FIG. 2 is a bottom perspective view of an exemplary first connector for the assembly shown in FIG. 1.

FIG. 2 illustrates a bottom perspective view of the first connector 20 which is configured to receive the second connector 30 (shown in FIG. 1) of a peripheral device. The connector 20 includes a housing 80 that is substantially enclosed in the shield 40. The housing 80 includes a protrusion 82 which defines the mating end of the housing 80. The protrusion 82 extends from a back wall 86 (see FIG. 3) of the housing 80 to the connector mating face 42 (see FIG. 1) and carries electrical contacts 88 and 89 on upper and lower surfaces 90 and 92 respectively. The contacts 88 and 89 are right angle contacts including terminal ends 94 that are configured to be mounted through apertures in the circuit board 50 (FIG. 1). The terminal ends 94 extend through a connector mounting surface that corresponds to a lower surface 96 of the back wall 86. The back wall 86 includes first and second ends 98 and 100, each defining a mounting hole 102 that is configured to receive a fastener for mounting of the connector 20 to the circuit board 50.

The shield 40 substantially encloses the housing 80 and includes a rearward portion 110 that surrounds the back wall 86 and a forward portion 112 that includes upper and lower walls 114 and 116, respectively, and end walls 118 and 120. The upper and lower walls 114 and 116 along with the end walls 118 and 120 define a cavity 122 within which the protrusion 82 is located. The upper and lower walls 114 and 116 and the end walls 118 and 120 each includes a curved lip 130 at the forward end 52 (see FIG. 1). The curved lips 130 provide guidance for a mating connector, such as the second connector 30. The upper and lower walls 114 and 116 and the end walls 118 and 120 each includes at least one flexible finger 132 formed therein to make contact with the grounding shield 66 (FIG. 1) of the mating connector 30. The shield 40 also includes grounding tabs 134 at the forward end 52. The grounding tabs 134 extend at an angle from the shield forward end 52 and are provided to engage a grounding element (not shown in FIG. 2) proximate the forward end 52.

Figure 3:
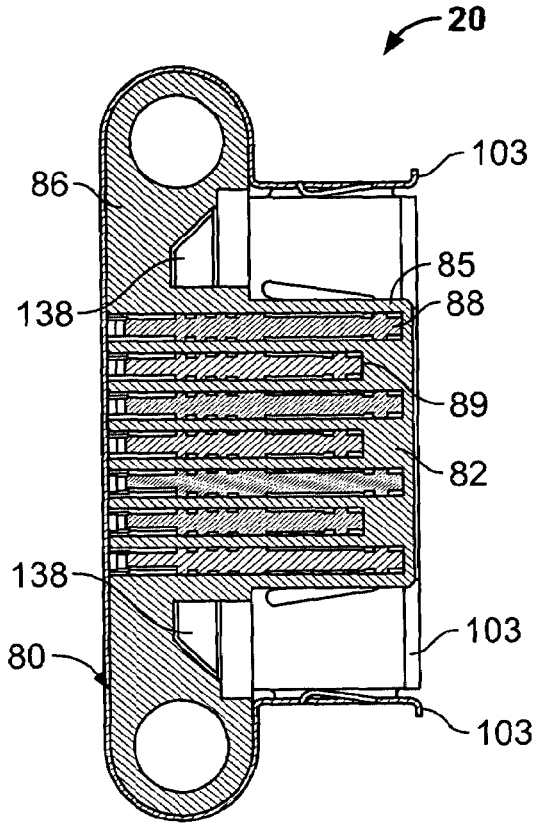
FIG. 3 is a cross sectional view of the connector shown in FIG. 2 taken along line A—A.

FIG. 3 is a cross sectional view of the of the connector 20 taken along the line A—A in FIG. 2 which is along the upper surface 90 of the protrusion 82. The protrusion 82 carries two rows of contacts 88, 89, a first row 85 in registry with the upper surface 90 and a second row 87 in registry with the lower surface 92 (see FIG. 2). The contacts 88 have a longer blade that the contacts 89. The contacts 88 and 89 are arranged in an alternating pattern such that in each contact row 85 and 87, adjacent contacts 88 and 89 are staggered with respect to one another so as to provide a mate first, break last connection with the second connector 30. That is, the long contacts 88 are the first to mate and the last to break contact with the contacts 72 of the second connector 30 when the first and second connectors 20 and 30 are mated and then unmated.

Guidance for blind-mate connection is provided by the curved lips 130 on the shield 40. The shield 40 receives the mating end 62 of the mating connector 30. The housing 80 includes relief pockets 138 that receive the alignment towers 154 (see FIG. 4) on the connector 30 when the connectors 20 and 30 are mated.

Figure 4:
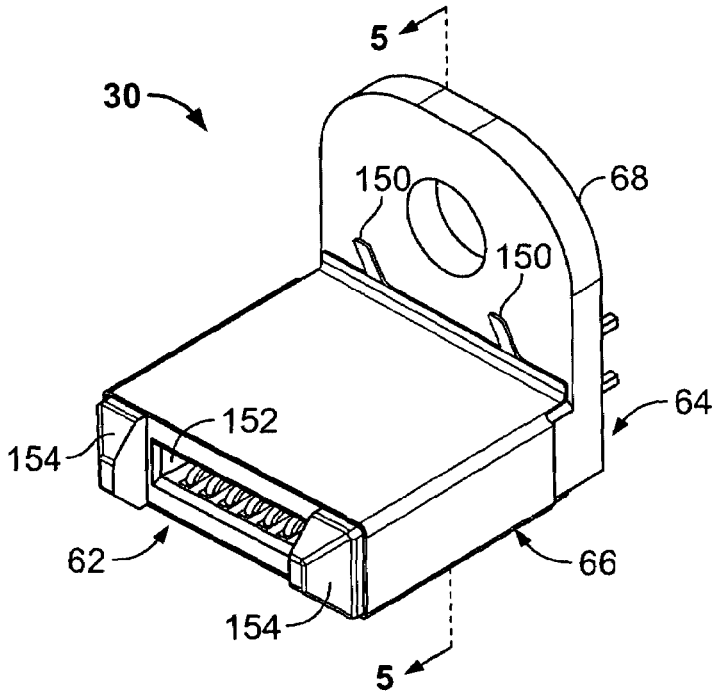
FIG. 4 is a front perspective view of an exemplary second connector for the assembly shown in FIG. 1.

FIG. 4 is a front perspective view of the second connector 30. In an exemplary embodiment, the connector 30 is a floating receptacle connector that is mountable to a panel and is free to move in the X and Y directions (See FIG. 1) to align itself with a mating connector such as the connector 20. The connector 30 includes a conductive shield 66 surrounding the mating end 62. The shield 66 extends rearward to the mounting tab 68 at the mounting end 64. The shield 66 includes grounding tabs 150 positioned at the base of the mounting tab 68 that angle forward toward the mating end 62 of the connector 30 to engage a grounding element (not shown) proximate the forward facing side of the mounting tab 68 at the mounting end 64.

The housing 60 includes an opening 152 that is sized to receive the protrusion 82 on the connector 20. An alignment tower 154 extends longitudinally forward from the mating end 62 on either side of the opening 152. The alignment towers 154 each have tapered upper, lower, and exterior side surfaces that facilitate entry of the alignment towers into the shield 40 of the connector 20. The alignment towers 154 are received in the shield forward end 52 on the connector 20 so that the connector 30 can align itself with respect to the connector 20 when the connectors 20 and 30 are joined together.

Figure 5:
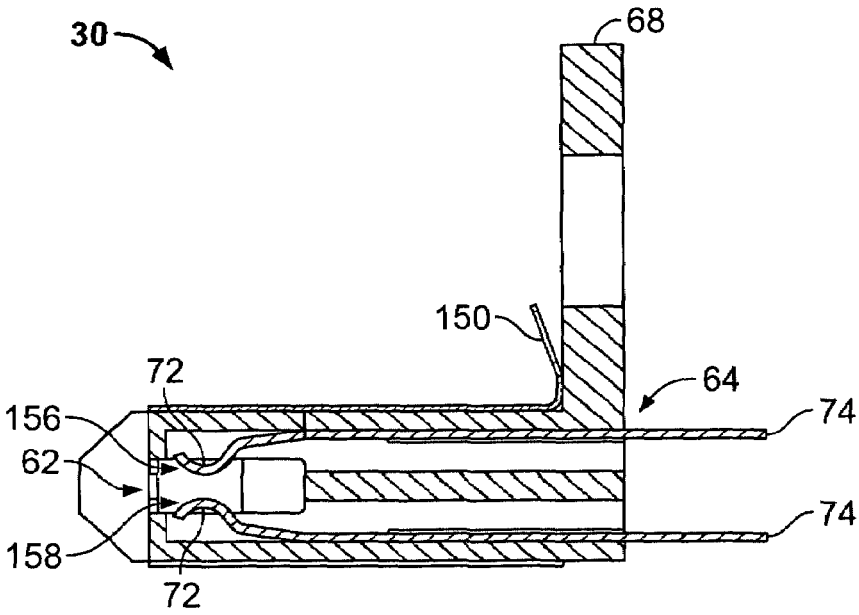
FIG. 5 is a cross sectional view of the connector shown in FIG. 4 taken along line B—B.

FIG. 5 is a cross sectional view of the connector 30 taken along the line B—B as shown in FIG. 4. Electrical contacts 72 are arranged in an upper row 156 and an opposed lower row 158 in the housing 60. The upper and lower rows of electrical contacts 156 and 158 respectively mate with the contacts 88 and 89 on the upper and lower surfaces 90 and 92 respectively on the protrusion 82 when the connectors 20 and 30 are mated. The contact ends 74 extend rearwardly through the mounting end 64 of the connector 30. In an exemplary embodiment, the contact ends 74 are provided with solder pads for making a solder connection to a cable or a wire (not shown).

Figure 6:
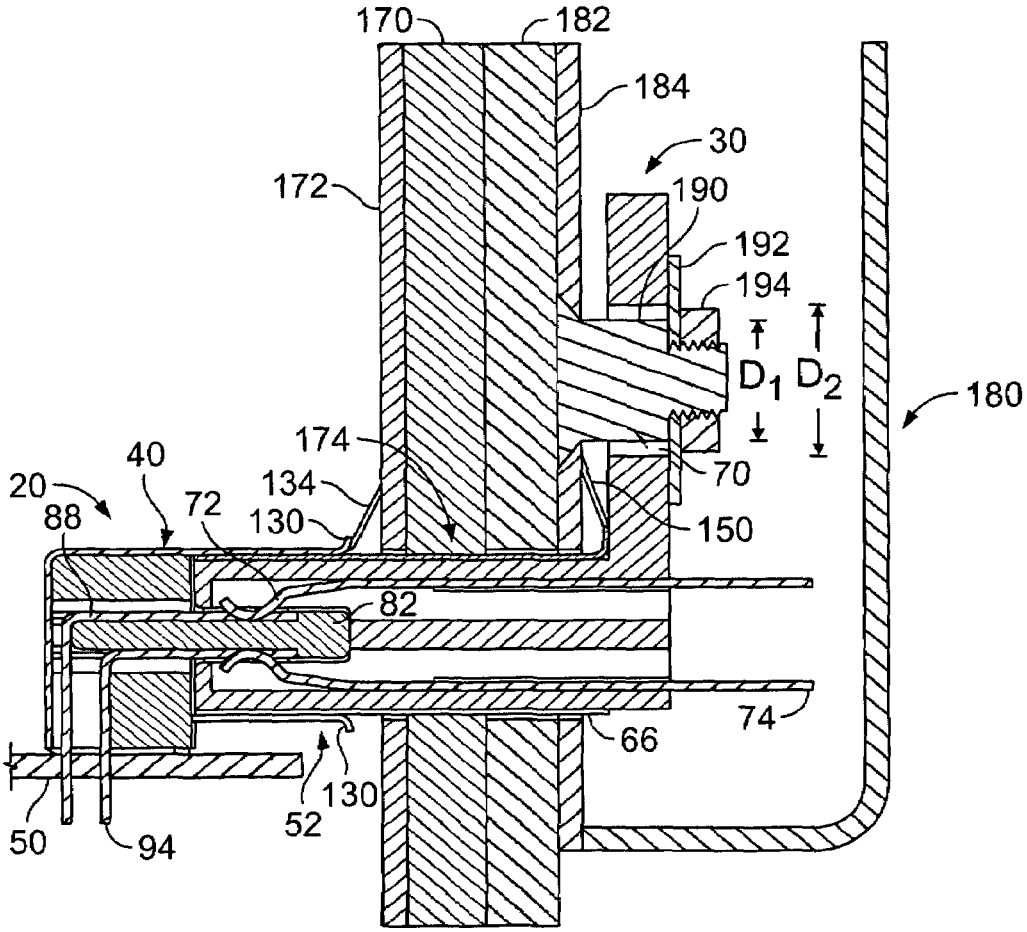
FIG. 6 is a cross sectional view of the first and second connectors shown in FIG. 1 in a mated condition, the cross section taken along line B—B of the second connector as shown in FIG. 4.

Use of the blind mate connector assembly 10 will be described with reference to FIG. 6 which illustrates a cross sectional view of the connectors 20 and 30 in a mated condition, the cross section taken along the line B—B in FIG. 4.

The first connector 20 is installed on the circuit board 50 and is inside a primary electronic device (not shown) that has an outer case 170. The connector 20, in an exemplary embodiment is a plug connector that is fixedly mounted on the circuit board 50 in the primary electronic device. An interior grounding plate 172 is positioned adjacent the outer case 170. The grounding tabs 134 on the shield forward end 52 engage the grounding plate 172 to ground the shield 40 that encases the connector 20 to provide EMI suppression. The outer case 170 is provided with a port 174 through which an accessory or peripheral device 180 can be plugged into the primary electronic device.

The second connector 30 is mounted within the peripheral device 180 and can be plugged into the primary electronic device through the port 174. The peripheral device 180 includes an outer front case 182 that abuts the outer case 170 of the primary device when the peripheral device 180 is plugged into the primary electronic device. An interior grounding plate 184 is positioned adjacent the outer case 182. In one embodiment, the second connector 30 is a floating receptacle connector that is panel mounted inside the peripheral device 180. The connector 30 is mounted within the peripheral device 180 using a fastener 190 that has a diameter $D_1$ that is smaller than the inside diameter $D_2$ of the mounting hole 70 in the mounting tab 68 on the connector 30. A washer 192 and a nut 194 may also be used in conjunction with the fastener 190. The difference in the diameters $D_1$ and $D_2$ allows the connector 30 to float in the X and Y directions (see FIG. 1) to align itself with respect to the connector 20 during the mating process. In one embodiment, the fastener 190 attaches the connector 30 to the grounding plate 184, however, it is to be understood that other interior surfaces may be provided along with other mounting arrangements which are well known in the art. The connector 30 is positioned within the peripheral device so that the grounding tabs 150 engage the grounding plate 184 to ground the shield 66 to provide EMI suppression.

During the mating process, the peripheral device 180 is brought to the primary electronic device so that the mating end 62 (see FIG. 4) of the connector 30 is received in the port 174 in the outer case 170 of the primary device. Whereas the typical blind mate assembly includes complimentary guidance features on both connector housings, in the assembly 10, guidance on the connector 20 is provided by the shield forward end 52, which allows the connector 20 to fit into a smaller space in the primary electronic component. As the connector 30 is advanced into the port 174, the towers 154 (see FIG. 4) of the connector 30 engage the curved lips 130 on the shield forward end 52 of the connector 20. The connector 30 then floats to position itself so that the shielded mating end 62 of the connector 30 can be received in the shielded forward end 52 of the connector 20 and then into the cavity 122 (FIG. 2) of the connector 20. Upon further advancement of the second connector 30, the protrusion 82 of the connector 20 is received in the opening 152 of the connector 30 and the contacts 72 in the connector 30 mate with the long and short contacts 88 and 89 respectively (see FIG. 2) of the connector 20, mating first with the long contacts 88. Once mated, the flexible fingers 132 (see FIG. 2) on the shield 40 of the first connector 20 engage the shield 66 of the second connector 30 to ground the connectors 20 and 30 to one another to minimize EMI interference. When the connectors 20 and 30 are separated, the long contacts 88 in the first connector 20 are the last to break with the contacts 72, thus providing mate first, break last operation.

Figure 7:
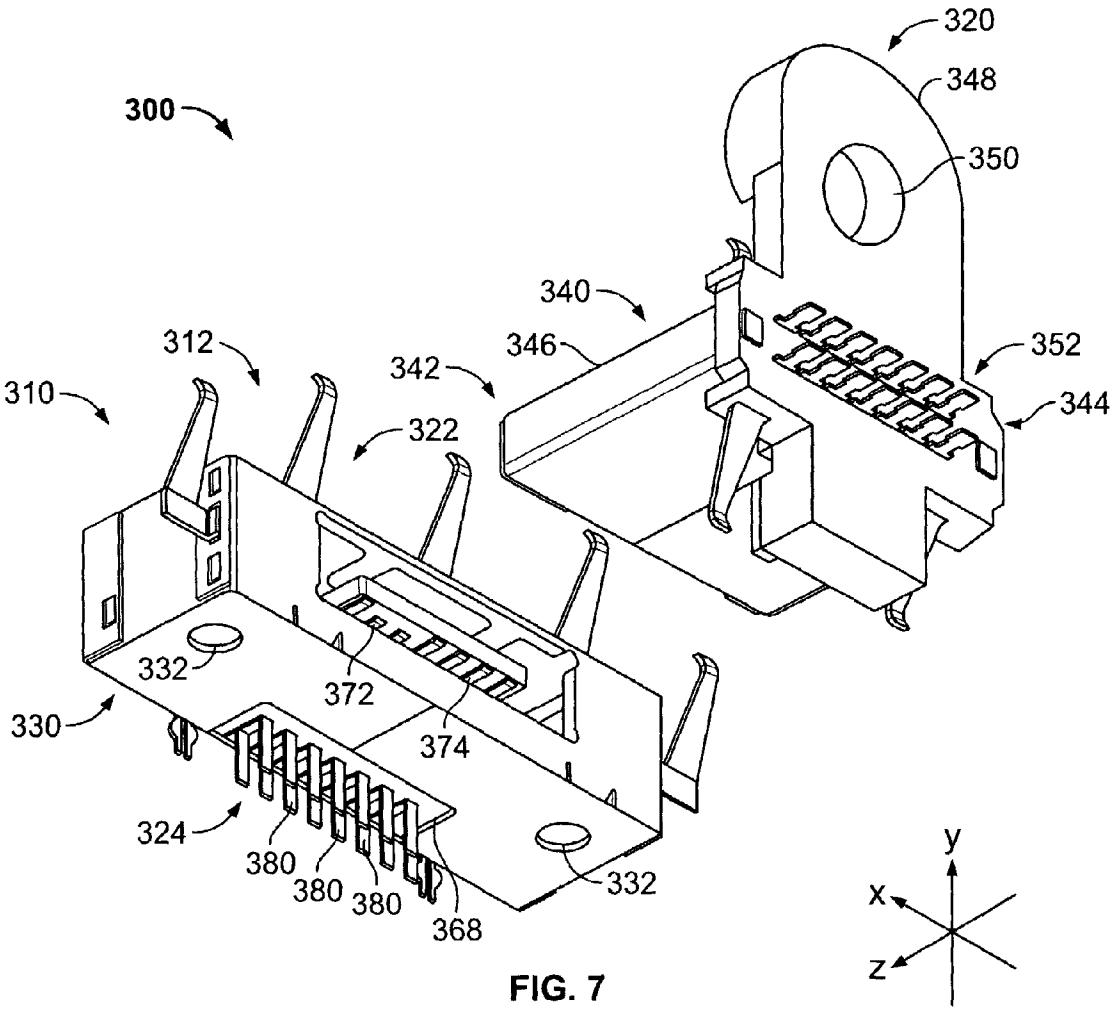
FIG. 7 is a perspective view of a blind mate connector assembly according to an alternative embodiment of the present invention.

FIG. 7 illustrates an blind-mate connector assembly 300 according to an alternative embodiment of the present invention. The assembly 300 includes a first connector 310 which is a plug connector and a second connector 320 which is a receptacle connector. The first connector 310 can be mounted on a circuit board (not shown in FIG. 7) within an electronic device. The second connector 320 can be connected to a peripheral device or accessory component.

The connector 310 includes a housing 312 that has a mating end 322 configured to mate with a mating connector such as the second connector 320. The connector 310 has a mounting end 324 that is configured to mount to a circuit board. The housing 312 is substantially enclosed in a conductive shield 330 that is provided to minimize the effects of electromagnetic interference (EMI). The shield 330 surrounds the mating end 322 of the connector 310 and provides guidance for the second connector 320 during the mating process. Mounting holes 332 are provided to mount the connector 310 to a circuit board (not shown).

The second connector 320 is a receptacle connector. More specifically, the second connector 320 is a floating receptacle connector that is configured to be mounted to a panel of the peripheral device (not shown in FIG. 7). The connectors 310 and 320 are mated by moving the connectors 310 and 320 together in the Z direction. During the mating process, the second connector 320 is free to move in the X and Y directions to align itself for blind-mating with the first connector 310. The second connector 320 includes a housing 340 that has a mating end 342 and a mounting end 344. The mating end 342 is surrounded by a conductive shield 346 that is provided to minimize EMI interference. The mounting end 344 includes a mounting tab 348 that extends vertically upward substantially perpendicular to the mating end 342. The tab 348 includes a mounting hole 350 to movably attach the mounting end 344 to the panel of the peripheral device. A plurality of electrical contacts 352 are provided to electrically connect the second connector 320 to the peripheral device. The contacts 352 extend through the housing 340 to the mating end 342 to mate with contacts in a mating connector.

Figure 8:
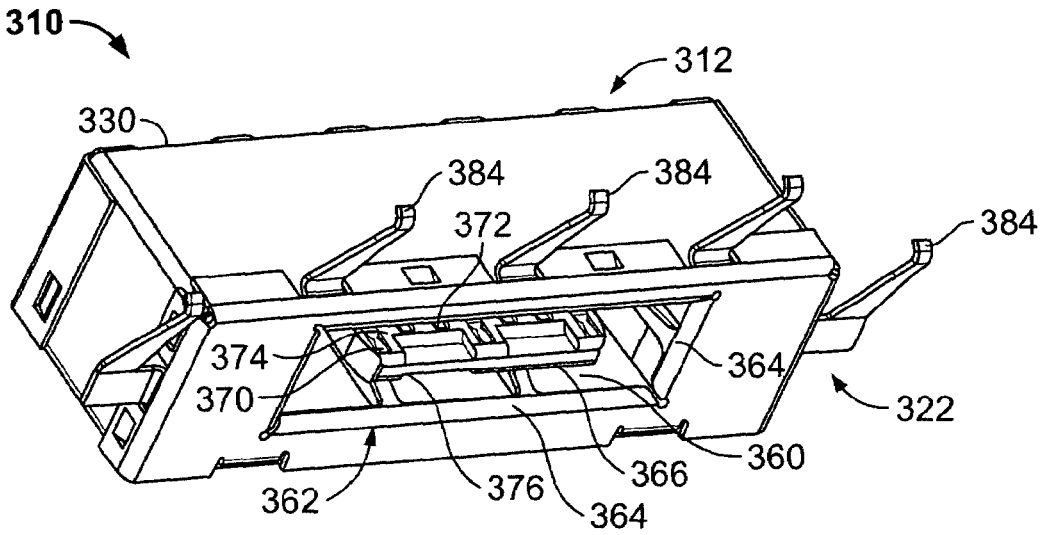
FIG. 8 is a perspective view of the first connector shown in FIG. 7.

FIG. 8 illustrates a perspective view of the first connector 310 which is configured to receive the second connector 320 (FIG. 7). The housing 312 of the connector 310 is substantially enclosed in the shield 330 which includes an opening 360 that receives the mating end 342 of the second connector 320. The opening 360 has a perimeter 362 that includes inwardly curved edges 364 of the shield 330. The inwardly curved edges 364 of the shield 330 provide guidance to facilitate entry of the mating end 342 of the second connector 320 into the opening 360. The housing 312 includes a protrusion 366 that forwardly extends from a back wall 368 (FIG. 7) of the housing 312 which carries electrical contacts 370 and 372 on both an upper surface 374 and a lower surface 376. The electrical contacts 370 and 372 are right angle contacts that have terminal ends 380 (see FIG. 7) that are configured to be mounted through apertures in a circuit board (not shown). The shield 330 also includes grounding tabs 384 proximate the mating face 322 of the connector 310. The grounding tabs 384 extend at an angle from the shield 330 and are provided to engage a grounding element (not shown in FIG. 8) proximate the mating face 322 of the connector 310.

Figure 9:
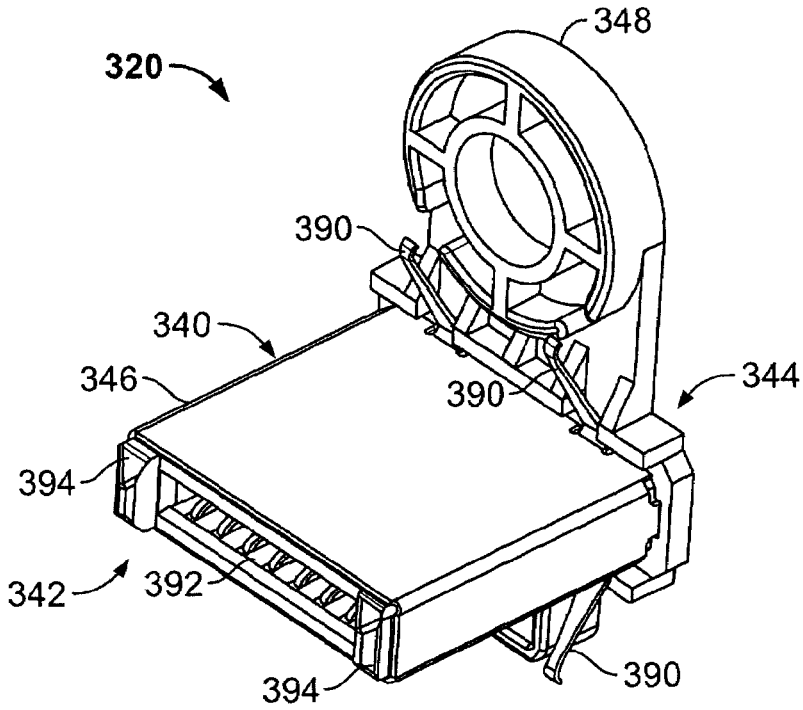
FIG. 9 is a perspective view of the second connector shown in FIG. 7.

FIG. 9 is a perspective view of the second connector 320 shown in FIG. 7. In an exemplary embodiment, the connector 320 is a floating receptacle connector that is mountable to a panel and is free to move in the X and Y directions (see FIG. 7) to align itself with a mating connector such as the connector 310. The connector 320 includes a conductive shield 346 surrounding the mating end 342 of the connector 320. The shield 346 extends rearward to the mounting tab 348 at the mounting end 344. The shield 346 includes grounding tabs 390 positioned at the base of the mounting tab 348 that angle forward toward the mating end 342 to engage a grounding element (not shown) proximate the forward facing side of the mounting tab 348 at the mounting end 344.

The housing 340 includes an opening 392 that is sized to receive the protrusion 366 on the connector 310. An alignment tower 394 extends longitudinally forward from the mating end 342 on either side of the opening 392. The alignment towers 394 each have tapered upper, lower, and exterior side surfaces that facilitate entry of the alignment towers 394 into the shield 330 of the connector 310. The alignment towers 394 are received in the opening 360 of the shield 330 on the connector 310 so that the connector 320 can align itself with respect to the connector 310 when the connectors 310 and 320 are joined together.

The embodiments thus described provide a shielded blind mate connector assembly 10, 300 that includes a first connector 20, 310 having a shield 40, 330 that, in addition to providing EMI suppression, also performs the function of providing guidance so that the second connector 30, 320 can self align during the mating process. By providing guidance features in the shielding rather than in the housing of the connectors, the overall size of the assembly may be reduced in comparison to known blind-mate connectors. The assembly 10, 300 is suited for use in connecting an accessory or a peripheral device 180 to a primary electronic device. The first connector 20, 310 is configured to be mounted on a circuit board 50 while the second connector 30, 320 is configured to be panel mounted so that it has the capability to float during the mating process.

While the invention has been described in terms of various specific embodiments, those skilled in the art will recognize that the invention can be practiced with modification within the spirit and scope of the claims.

What is claimed is:

1. A blind matable connector assembly comprising:

a first connector comprising:

a first conductive shield, said first conductive shield comprising a guidance element; and a first housing substantially enclosed within said first conductive shield, said first housing including a mating end and a mounting end, said first housing having a back wall at said mounting end and a protrusion extending from said back wall toward said mating end, said back wall having a lower surface comprising a connector mounting surface; and a second connector matable with said first connector, said second connector comprising:

a second housing including a mating end and a mounting end, said mounting end including a portion extending vertically upward substantially perpendicular to said mating end, said mounting end defining a mounting hole for movable attachment of said mounting end to a panel; and a second conductive shield surrounding said mating end of said second housing, said guidance element of said first conductive shield receiving said second conductive shield and said mating end of said second housing whereby said second connector self aligns for blind-mating with said first connector.

2. The assembly of claim 1, wherein said first conductive shield includes a forward end and said guidance element comprises a curved lip at said forward end.

3. The connector of claim 1, wherein said second connector is free to float along two axes of movement to self align with said first connector.

4. The assembly of claim 1, wherein said second housing further includes an opening located between a pair of alignment towers, said opening configured to receive said protrusion.

5. The assembly of claim 1, wherein said mating end of said second housing includes a pair of alignment towers longitudinally extending from said mating end, each said alignment tower having tapered side surfaces to guide said mating end into said guidance element.

6. The assembly of claim 1, wherein said protrusion has an upper surface and a lower surface, and said first housing includes a plurality of electrical contacts comprising a first row of contacts in registry with said upper surface and a second row of contacts in registry with said lower surface.

7. The assembly of claim 1, wherein said first housing includes a plurality of electrical contacts comprising a first row of electrical contacts and a second row of electrical contacts wherein adjacent contacts in said first and second rows are staggered with respect to one another.

8. A blind matable electronic assembly comprising:

a primary device comprising:

a first connector located in an interior region of said primary device, said first connector including a first conductive shield, said first conductive shield comprising a guidance element for a mating blind-mate connector and a first housing substantially enclosed within said first conductive shield, said first housing including a mating end and a mounting end, said first housing having a back wall at said mounting end and a protrusion extending from said back wall toward said mating end, said back wall having a lower surface comprising a connector mounting surface; and a peripheral device located outside said primary device and blind-matable with said primary device, said peripheral device comprising:

a panel;

a second connector matable with said first connector, said second connector including a second housing having a mating end and a mounting end, said mounting end including a portion extending vertically upward substantially perpendicular to said mating end, said mounting end movably mounted to said panel to permit relative movement of said mating end with respect to said panel, and a second conductive shield surrounding said mating end of said second housing, said guidance element receiving said second conductive shield and said mating end of said second housing whereby said second connector self aligns for blind-mating with said first connector to blind-mate said peripheral device with said primary device.

9. The assembly of claim 8, wherein said first conductive shield includes a forward end and said guidance element comprises a curved lip at said forward end.

10. The assembly of claim 8, wherein said guidance element of said first conductive shield receives said mating end of said second housing to position said mating end of said second housing about said protrusion.

11. The assembly of claim 8, wherein said protrusion has an upper surface and a lower surface, and said first housing includes a plurality of electrical contacts comprising a first row of contacts in registry with said upper surface and a second row of contacts in registry with said lower surface.

12. The assembly of claim 8, wherein said second connector is free to float along two axes of movement to self align with said first connector.

13. A panel mount connector for use in a blind-mate connector assembly, said panel mount connector comprising:

a housing including a mating end and a mounting end, said mounting end including a portion extending vertically upward substantially perpendicular to said mating end, said mounting end defining a mounting hole for movable attachment of said mounting end to a panel; and a conductive shield encasing said mating end, said shield including a grounding tab configured to engage a grounding element proximate said mounting end, wherein said mating end includes a pair of alignment towers longitudinally extending from said mating end, each said alignment tower having tapered side surfaces to guide said mating end into a mating connector.

14. The connector of claim 13, wherein said housing mating end and said shield are configured to be received together in a shield surrounding a mating end of the mating connector.

15. The connector of claim 13, wherein said housing mating end includes an opening configured to receive a mating element of the mating connector.

* * * * *